US010287782B2

(12) United States Patent
Krokfors et al.

(10) Patent No.: US 10,287,782 B2
(45) Date of Patent: May 14, 2019

(54) BUILDING CONCEPT, VERTICAL DUCT ELEMENT AND METHOD FOR ARRANGING SPACES IN A FLEXIBLE MANNER WITHIN THE BUILDING

(71) Applicant: Arkkitehtitoimisto Karin Krokfors Oy, Helsinki (FI)

(72) Inventors: Karin Krokfors, Helsinki (FI); Anders Westerlund, Helsinki (FI); Jörgen Holm, Helsinki (FI); Ari Kortemaa, Helsinki (FI)

(73) Assignee: Arkkitehtitoimisto Karin Krokfors Oy, Helsinki (FI)

( * ) Notice: Subject to any disclaimer, the term of this patent is extended or adjusted under 35 U.S.C. 154(b) by 0 days.

(21) Appl. No.: 15/108,793

(22) PCT Filed: Dec. 30, 2014

(86) PCT No.: PCT/FI2014/051060
§ 371 (c)(1),
(2) Date: Jun. 29, 2016

(87) PCT Pub. No.: WO2015/101710
PCT Pub. Date: Jul. 9, 2015

(65) Prior Publication Data

US 2016/0326737 A1 Nov. 10, 2016

(30) Foreign Application Priority Data

Dec. 31, 2013 (FI) ..... 20136343

(51) Int. Cl.
*E04F 17/00* (2006.01)
*E04B 1/348* (2006.01)
(Continued)

(52) U.S. Cl.
CPC ..... *E04F 17/00* (2013.01); *E04B 1/343* (2013.01); *E04B 1/348* (2013.01);
(Continued)

(58) Field of Classification Search
CPC ..... E04B 1/343; E04B 1/348; E04B 1/34869; E04C 2/521; E04F 17/08; E04F 17/00
See application file for complete search history.

(56) References Cited

U.S. PATENT DOCUMENTS 3,605,354 A * 9/1971 Hodgetts ..... E04B 1/34 52/185
3,710,521 A 1/1973 Danin
(Continued)

FOREIGN PATENT DOCUMENTS

CN 1108727 C 5/2003
FI 5306 U1 4/2002
(Continued)

*Primary Examiner* — Adriana Figueroa
*Assistant Examiner* — Jessie T Fonseca
(74) *Attorney, Agent, or Firm* — Seppo Laine Oy

(57) ABSTRACT

The invention relates to a building concept wherein locations of rooms such as bathrooms and kitchens can be easily changed during the lifespan of the building. These rooms may be positioned in several locations almost everywhere in the building and the building may be easily remodeled during its lifespan. The invention is based on providing at least one space part that comprises a floor defining the area of the space part and at least one length of non-load bearing wall bordering the perimeter of the floor and at least one load bearing vertical duct element having at least one vertical cover wall that can be at least partially opened in order to provide access to the inside of the element.

25 Claims, 15 Drawing Sheets

(51) Int. Cl.
*E04F 17/08* (2006.01)
*E04B 1/343* (2006.01)
*E04B 2/00* (2006.01)

(52) U.S. Cl.
CPC ..... *E04B 1/34869* (2013.01); *E04B 2/00* (2013.01); *E04F 17/08* (2013.01)

(56) References Cited

U.S. PATENT DOCUMENTS 3,952,465 A 4/1976 Masiello
5,174,081 A 12/1992 Reichartz
6,247,280 B1 * 6/2001 Grinshpun ..... E04B 2/8635 52/309.12
2005/0108957 A1 * 5/2005 Quesada ..... E04H 1/1266 52/143
2007/0051067 A1 * 3/2007 Wall ..... E04B 1/34336 52/843
2009/0293384 A1 * 12/2009 Miller ..... E04F 11/02 52/185
2011/0041415 A1 * 2/2011 Esposito ..... E04B 1/34331 52/12
2011/0099918 A1 * 5/2011 Buchmann ..... E03C 1/01 52/79.1
2011/0296778 A1 * 12/2011 Collins ..... E04C 2/521 52/220.1
2014/0352232 A1 * 12/2014 Malakauskas ..... E04B 1/34869 52/79.9
2015/0033642 A1 * 2/2015 Johnson ..... E04B 2/827 52/173.1

FOREIGN PATENT DOCUMENTS

JP 2009097256 A 5/2009
RU 204646 C1 7/1995
RU 2114961 C1 7/1998
WO WO0023666 A1 4/2000
WO WO2004048710 A1 6/2004
WO WO2009005449 A1 1/2009

* cited by examiner

LAMELLA

POSSIBLE COMBINATION OF LAMELLAS

POSSIBLE COMBINATION OF LAMELLAS

POSSIBLE COMBINATION OF LAMELLAS

POSSIBLE COMBINATION OF LAMELLAS

LOAD-BEARING STRUCTURES

BUILDING CONCEPT, VERTICAL DUCT ELEMENT AND METHOD FOR ARRANGING SPACES IN A FLEXIBLE MANNER WITHIN THE BUILDING

TECHNICAL FIELD

The present invention concerns a building concept that enables the building to be modified to various purposes during the whole lifespan of the building starting from the planning and construction and during its use until the possible demolition.

Especially the invention concerns a building concept that provides flexible use of the space within the building and variability of dwellings and room spaces for various purposes and sizes.

BACKGROUND

Present building and design methods are based on an established way of thinking how to design apartments and arrange the space within the building. The apartments are produced as standardized sizes starting from one room unit to as many rooms as needed. After the building is finished, the possibilities to modify dwelling sizes, floor plan, numbers of rooms and room sizes in apartments are rather limited. The amount of modification work required is extensive and the changes are thus expensive. Changing the use of a building or apartments to other uses such as office or shop space or vice versa is difficult and the final outcome of the changes may be less than satisfactory. This results several problems. Wrong kinds of apartments are built in wrong places and demand is not satisfied. Residence areas may get profiled to certain resident profiles, which may deter the desirability of the apartments for other types of residents. Building property can't be optimally utilizes as changes of apartments size and type of use can't be done on basis of demand. One particular problem is that buildings can't be adapted to changes in society and modern housing needs or needs of the tenants. Future demands can't be predicted and thus adaptability would be desirable.

Flexibility in design and construction of buildings can be increased by providing large open spaces that can be divided by light, not load bearing divisioning walls in desired spaces or rooms and apartments. Usually this includes using a vertical duct well for water supply lines, sewers and possibly electric supply lines. Even though these systems provide increased flexibility, they limit location of kitchens, bathrooms and any room requiring sewer connection to the side of these vertical wells in certain areas of already defined flat size. These structures require placement of horizontal ducts and sewers in the floor and often embedding them in the floor structure so that locations of sewers and such is fixed or changing of the location of them requires extensive exposing of ducts within the floor or wall structures. Thus the modifiability of the room space is severely limited. Some examples of known structures are presented in documents CN 1108727, CN110359, JP2009097256, WO04048710 and U.S. Pat. No. 3,710,521.

SUMMARY OF INVENTION

Present building and construction methods limit the modifiability of buildings during its lifetime. For this reason, it would be beneficial to provide a building concept wherein the restrictions for changing the purpose of the space inside the building and how the space is divided in dwellings, rooms or other subspaces are minimized or at least reduced compared to known building structures.

In a first aspect, the invention relates to a building concept wherein locations of rooms such as bathrooms and kitchens can be easily changed during the lifespan of the building. These rooms may be positioned in several locations almost everywhere in the building and the building may be easily remodeled during its lifespan.

One embodiment of the invention provides a possibility to join or separate spaces in vertical direction, which provides more possibilities to grow dwellings into bigger entities or divide them into smaller ones.

Many of the embodiments and combinations of them provide several adjacent possibilities to change room lay-out both horizontally and vertically.

According to other aspects and embodiments of the present invention, the invention provides space parts which can be divided into space units that constitute nucleus for different size dwellings that can be joined or separated horizontally and vertically.

According to one further aspect of the invention, the invention provides a concept wherein passage to rooms or spaces is arranged to allow joining or separating the spaces.

The invention is based on providing at least one space part that comprises a floor defining the area of the space part and at least one length of non-load bearing wall bordering the perimeter of the floor and at least one load bearing vertical duct element having at least one vertical cover wall that can be at least partially opened in order to provide access to the inside of the element.

According to one embodiment of the invention, the concept comprises at least two space parts that are each bound at least on one side by vertical duct element.

According to one embodiment, at least one space part is bound on at least two opposite sides by load bearing vertical duct elements.

According to one embodiment of the invention, at least one space part is bound at least on one side by a non load bearing wall.

According to one embodiment, the sections of the wall of the vertical duct elements that can be opened are non-load bearing structures, i.e the vertical duct elements are dimensioned to carry structural loads without the openable sections.

According to one embodiment, the vertical duct elements have a quadrangular cross section and include three load bearing walls and one openable wall.

According to one embodiment of the invention, the space parts are bound by a floor that is manufactured, for example cast, on site.

According to one embodiment of the invention, the floors comprise at least one blockout or void reservation for passage between superimposed stores.

According to one embodiment of the invention, the load bearing frame of the building is made of vertical duct elements joined by floors to a load bearing lattice framework.

According to one embodiment of the invention, the space part comprises an openable suspended ceiling.

According to one embodiment of the invention, the invention comprises at least one stair well lamella that is bound on two opposite sides by vertical duct elements and comprises at least two floors and at least one stair well element for passage, such as stairwell, lift or both, between superimposed floors.

According to one embodiment of the invention, the invention comprises at least one frame lamella that is bound on two opposite sides by vertical duct elements. The frame lamella has entrance at least on ground level and preferably at least two stores and void reservations for passage between superimposed stores.

The invention provides essential benefits.

The invention provides a building concept that makes it possible to design a building that adapts to various space arrangements and purposes. Apartments or other functional space are composed of space units that can be combined or separated to entities having different sizes. A space unit is therefore a potential how, for example, the dwellings can be combined to an entity such a dwelling. The space units may be independently used. The size of an apartment of other room is not determined beforehand but the sizes adapt top need and demand during the life cycle of the building. Different space or apartment combinations can be formed almost endlessly and modified during the lifespan of the building to larger or smaller dwelling units or other functional spaces like offices, shops, storage rooms of production spaces. The created room spaces can quite freely specify into different purposes like neutral space, kitchen, toilet, bathroom etc.

Boxing-ins such as sewers, water, air removal and communications are placed in an at least partially openable element. The ducts or tubings (except for the air conditioning or ventilation ducts) inside the openable element may be protective covers wherein the actual operating pipes and ducts are placed. In this way the working pipes can be changed or replaces easily through recessed ceiling space into the protective covers. In this way it is not necessary to open the openable space in normal maintenance or modification work. However, all of the contents of the load bearing vertical duct element can be easily replaced within the openable element, if needed or desired. This enables access to buildings technical elements and changing and repairing them without need to dismantle the load bearing frame of the building. All void reservations can be covered when they are in use in order to provide neat wall surface. Horizontal extensions of electric lines and ventilation ducts distributed to different rooms on basis of needs and requirements of the room are preferably placed within a suspended ceiling.

Division of the room spaces is done as non-load bearing structures which enables free variation of the floor plans. On the other hand, the essential ducts for air removal, air conditioning, water, sewage, electricity and all other technical facilities are placed within the load bearing part of the building. This is the longest lasting part of any building whereby all other aspects of the building can be modified without limitations of locations of technical facilities or ducts that they require.

Electric power connection boards (per space unit) may be placed in stairwells outside dwelling or other room spaces in lockable cupboards. In this way it is possible to rewire the electric connections as needed without entering the dwellings.

Other objects and features of the invention will become apparent from the following detailed description considered in conjunction with the accompanying drawings. It is to be understood, however, that the drawings are intended solely for purposes of illustration and not as a definition of the limits of the invention, for which reference should be made to the appended claims.

DESCRIPTION OF EMBODIMENTS

Definitions

A lamella is an independent section of a building or even an independent building having one or more stores and bound at least on one side but preferably on two opposite sides by vertical duct elements.

A stair well lamella is a lamella having a stair well providing an access to the building and spaces and rooms within the lamella. Typical use of this type of lamella is dwellings, but any other use is feasible.

A frame lamella is a lamella having an entrance and at least void reservations for passage between superimposed stores. This type of lamella may be used also for other space needs than dwellings.

A space part is space that is bound on at least one side by one load bearing vertical duct element to form an open space defined by load bearing vertical duct elements and non-load bearing walls around a perimeter of floor.

A space unit is a subpart of a space part having at least one entrance, an access into at least one vertical duct element, the space unit being the smallest nucleus to create an individual dwelling A space unit may have an entrance from a passage or through another space unit having entrance to a passage between floor levels. A structure called a load bearing wall has a specific meaning in building industry. Load bearing walls are walls that must support the dead load of their own weight and the weight of subsequent bearing structural members placed upon them. In addition, load bearing walls must be capable to carry the load of "live" loads that are anticipated to be placed upon the system without deflection that can degrade or negatively impact structural integrity.

A non-load bearing walls are walls that are only intended to support themselves and the weight of the cladding or sheathings attached. Non load bearing walls provide no structural support and may be interior or exterior walls. Non load bearing walls may be braced to resist minimum lateral loads in some jurisdictions.

Figure 1:
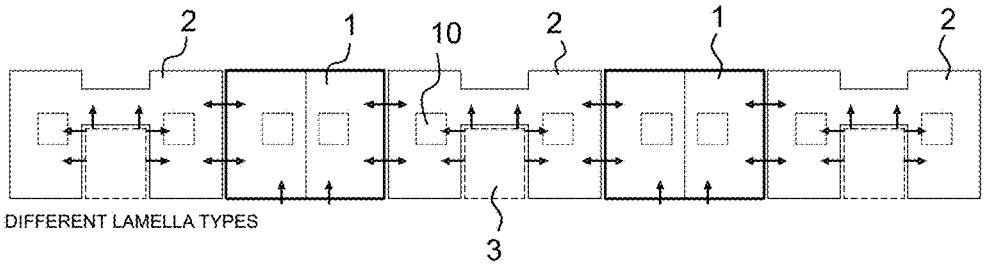
FIGS. 1 5 show an example of layout and positioning of various elements of the invention.
Figure 2:
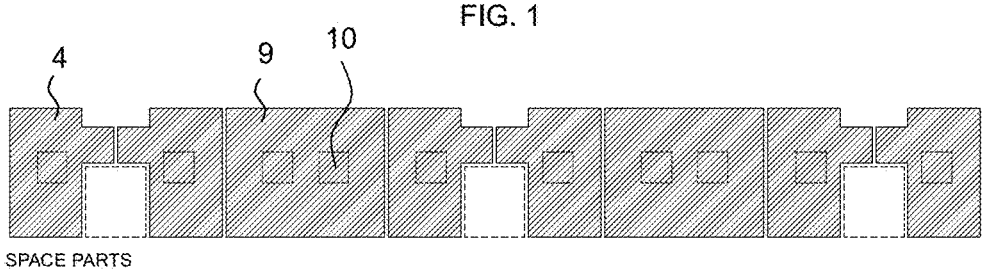
Figure 3:
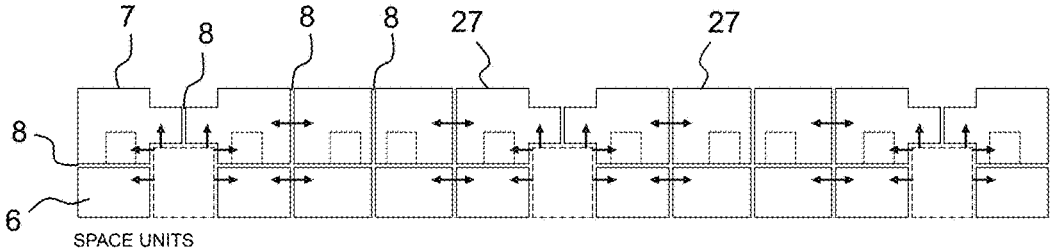

FIG. 1 illustrates the idea of two different lamellas and how they define access to various parts of the building. In this example two frame lamellas 1 are placed between three stair well lamellas 2. Each of the stair well lamellas 2 include a stair well 3 placed within the U-shaped lamella 2. The stair well 3 provides access to space units 4, and 6 of the stair well lamella 2 as is shown by arrows in FIGS. 1 and 3. Access to the frame lamella is arranged through the ground floor, as is also shown by arrows in FIG. 1. In this embodiment stair well lamella 2 comprises two space parts 4 on the sides of the stair well 3 in each floor. The space parts 4 have three entrances shown by arrows and can thus be divided by walls 8 into space units 6 and 7. The space units are the smallest units that can form a dwelling or other functional space of the building. One floor of a frame lamella 1 forms a space unit 9 that can be further divided into 2—four spaces located side by side that have an entrance from outside the building. Each of these spaces can be further divided to two space units with own entrance from elsewhere of the building. As can be seen from arrows showing the accesses directions in FIGS. 1 and 3, every space part 4. Sand space unit 5-7 in one floor can be accessed laterally. Vertical access is provided by stair well 3 and void reservations 10 in each larger space part. The void reservations can be equipped with a stairwell or a lift during construction of the building or at any time during the lifespan of the building.

Figure 4:
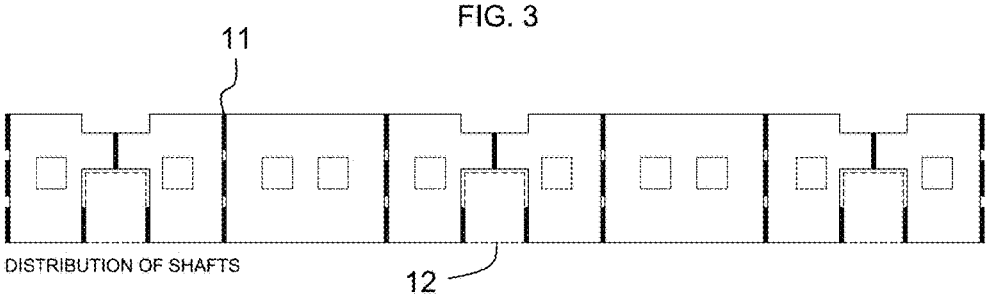
Figure 5:
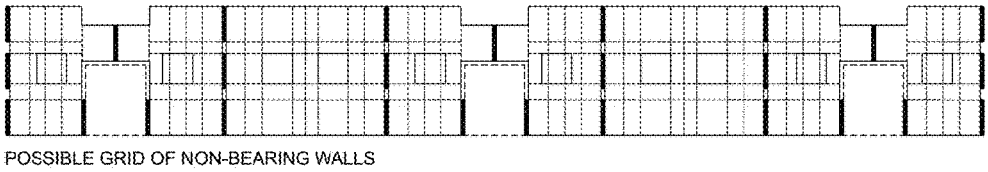

FIG. 4 shows the placement of vertical duct elements 11. These elements 11 have been placed between each lamella 1, 2, which in this example form the basic space parts 4, 9 bound at least partially on two sides by the vertical duct elements 11. The vertical duct elements 11 are dimensioned to bear most of the structural loads of the building. Depending the height of the building or the structural loads directed to it, the vertical duct elements should be dimensioned for different carrying capacity. In this way all space within the space parts and units can be used freely for different layouts. The vertical duct elements 11 have been arranged so between the lamellas 1, 2 that they provide openings for doors or accesses 12 between the lamellas 1, 2 and corresponding space parts and space units. The room lay-out can be freely arranged, one example of a lay out is shown in FIG. 5. The outer walls 27 joining the opposite vertical duct elements 11 are non load bearing. In this way windows or other openings can be placed freely over the area of the wall taking into consideration the possibility to divide room spaces in different way.

Figure 6A:
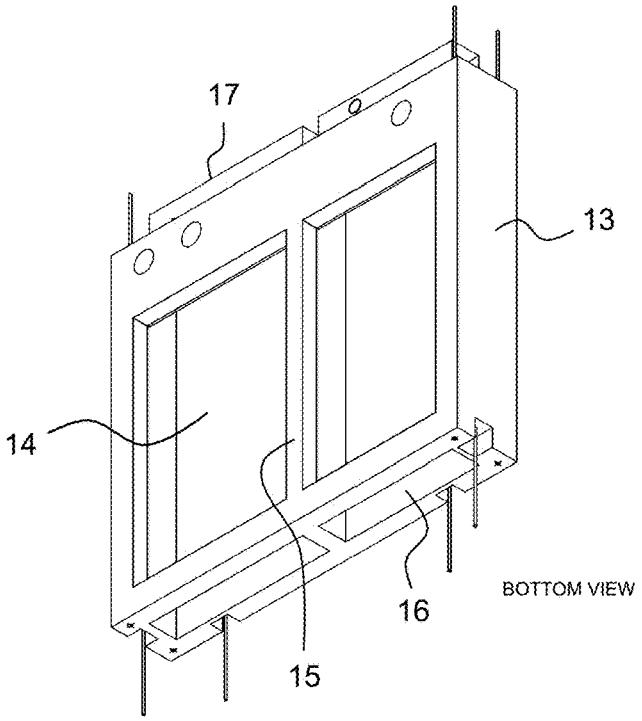
FIGS. 6*a* and 6*b* depict one embodiment of a vertical duct element.
Figure 6B:
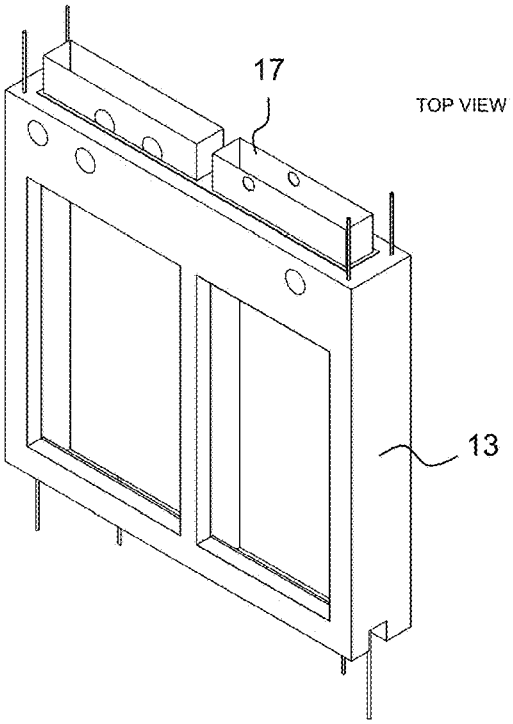

One embodiment of a vertical duct element is shown in FIGS. 6*a* and 6*b*. The cross section of the element is rectangular and it comprises a rectangular perimeter frame 13 having two openings 14. The openings 14 are divided by a central vertical division wall 15. The frame 13 and the division wall 15 are the load bearing elements of the duct element in this embodiment. At the bottom of each of the openings 14 are holes 16 and on top each opening is a casting cassette 17 made of steel plate. The casting cassette 17 forms the passage between superposed duct elements through a floor. The floor may be cast around the cassette from concrete or a built around it using wood structures or other conventional structural elements.

The frame 13, 15 is dimensioned to carry structural loads directed on the building and provides the rigidity of the element. The idea of load bearing vertical duct element is to combine it with floor elements, such as hollow core slabs, other concrete slabs, wooden load bearing wall or other element that carries the load over the floor span. The vertical duct element is placed between the floor levels so that load of the floor levels is placed on top of the vertical duct element. Thus, the vertical duct element and floor levels form a load bearing lattice wherein the loads in the vertical direction are carried by the vertical duct elements. In the embodiment of FIGS. 6*a* and 6*b*, a bottom surface of a vertical duct element is placed on a load bearing surface, for example on foundation or groundwork or on a slab forming a floor level. Elements forming the next floor level are placed on top surface of the vertical duct element. The floor levels are tied to vertical duct elements, for example by reinforcements (see FIGS. 6*a*, 6*b*) or casting cassettes 17. In this embodiment the casting cassettes 17 form also a lead through and passage through floor elements, for example hollow core slabs.

The load bearing structure made of vertical duct elements and floor levels is easy to design and build so that floor level elements rest on top of the vertical duct elements and superposed vertical duct element rests on top surface of the floor element. However, the vertical duct elements may be placed directly on top of each other. In such case the floor levels and vertical duct elements need connecting structures that can lead at least vertical loads from floor level elements to the vertical duct elements. Such connecting structures may be reinforcement bars fixed with cast concrete, grooves or ledges formed on the vertical duct elements on which the floor level elements may rest or a pin and hole connection, just to mention some alternatives.

The open spaces 14 inside the frame 13 are covered by a non-load bearing wall that can be opened or removed without compromising the rigidity or loadability of the element. This non-load bearing wall provides access to the hollow space 14 inside the vertical duct element 11 from both sides. The non-load bearing wall may be formed of masonry, for example already at element factory.

The access may be needed for reparations in the longer time span or modifications of the accessory placed inside the vertical duct element 11. The vertical duct elements include casing ducts for various purposes, such as cabling, plumbing, sewers, water, air removal, electricity, heating and communications or any technical feature included in the building.

A number of empty casing ducts may be reserved for future use. The ducts are mounted on the vertical duct wells by fittings and/or castings or seal elements at the ends of the vertical duct elements. In order to enable replacement or repair of the ducts, the space within the vertical duct element should be free open space and the ducts should be attached to the element so that they are easily replaceable. However, the space inside the vertical duct element may be filled with easily removable heat or noise insulation material, if needed.

Figure 7A:
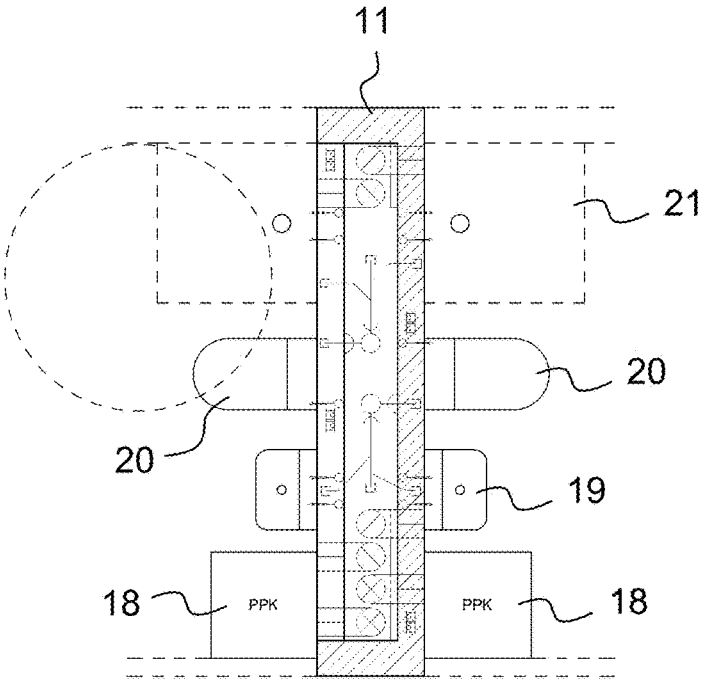
FIGS. 7*a* -7*d* depict alternatives to combine bathrooms and kitchens to vertical duct elements
Figure 7B:
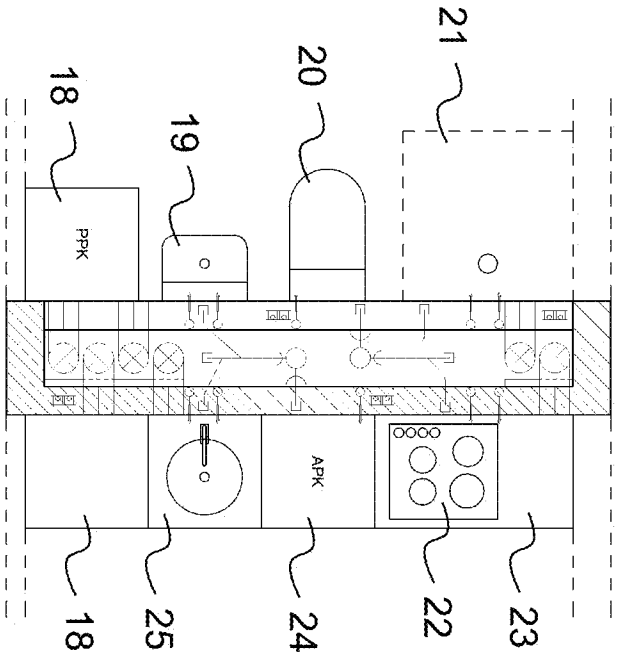

The vertical duct element 11 also includes couplings to domestic appliances and kitchen and bathroom fixtures. For example, FIG. 7*a* shows a lay-out for two bathrooms. In this example the vertical duct element 11 has an U-shaped frame 13. The room in the left is a bathroom having a washer 18, a sink 19, a toilet seat 20 and a shower cabin or place for a shower 21, all connected to the vertical duct element 11. On the opposite side of the vertical duct element 11 is a similar bathroom.

FIG. 7 b shows an arrangement having a bathroom described above on left side and a kitchen including a stove 22, a stove hood 23, a dishwasher 24, a washer 18 and a sink 25. These all are coupled to the vertical duct element 11.

Figure 7C:
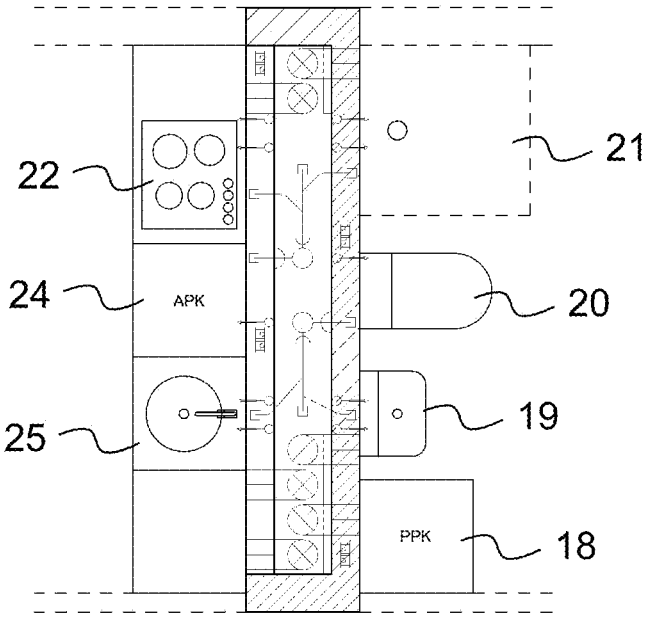
Figure 7D:
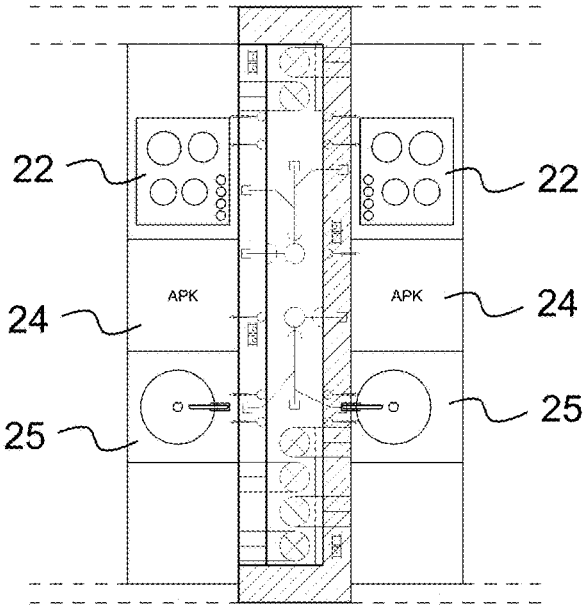

FIGS. 7*c* and *d* show more examples of different possibilities to arrange kitchens and bathrooms in combination with a vertical duct element according to the invention. FIG. 7*c* shows a similar bathroom and kitchen as above but on the opposite sides of the vertical duct element the stove 22, dishwasher 24 and a sink 18 are connected to the vertical duct element 11, or more particularly to the plumbing and electric cables within the vertical duct element 11. The vertical duct element in the FIG. 7*d* comprises two kitchens back to back.

Figure 8:
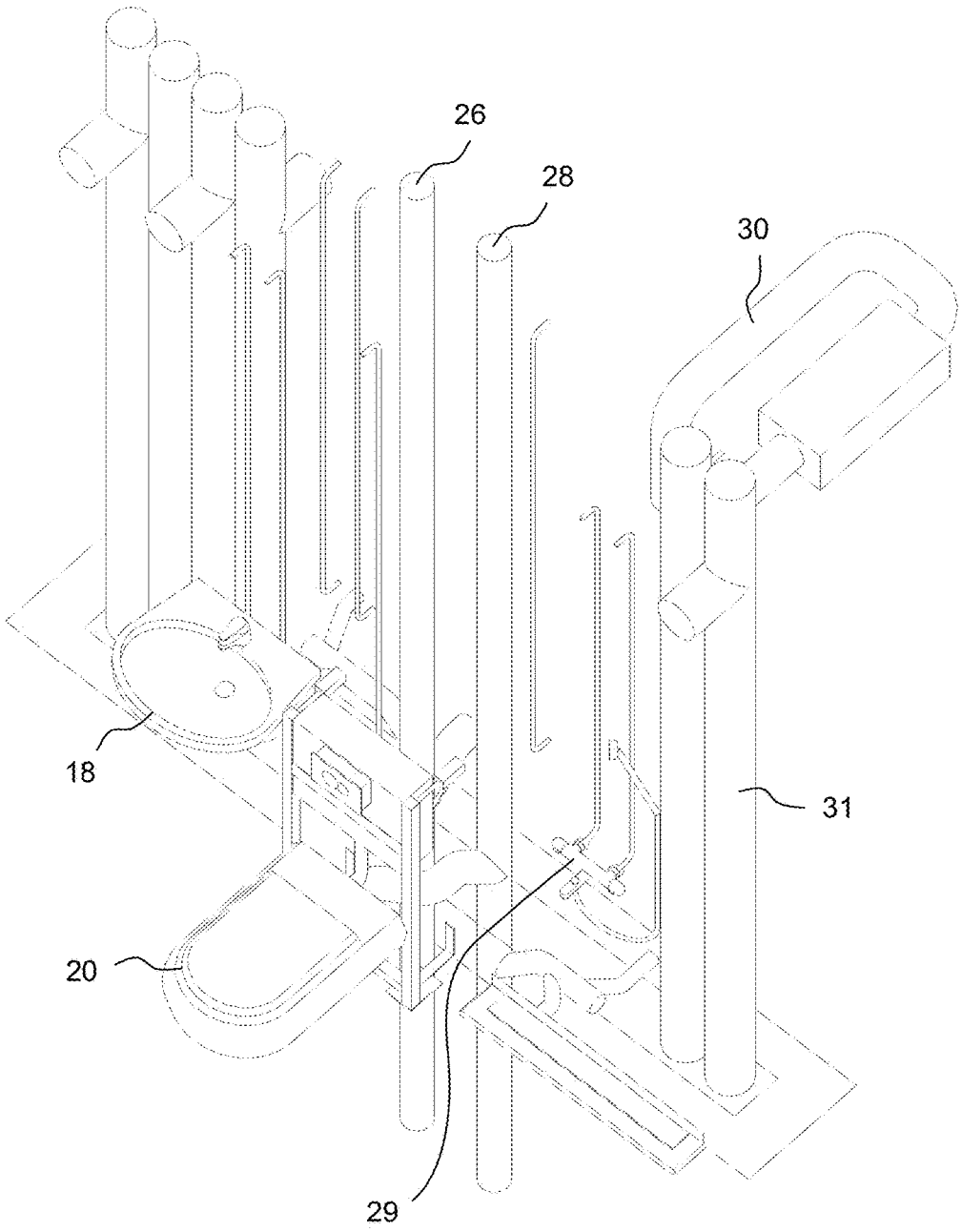
FIG. 8 is an illustrative view of one embodiment to arrange ducts of a bathroom according to the invention.

FIG. 8 shows an example of a bathroom arrangement. In this drawing the vertical duct element is removed and only the ducts inside are shown. As can be seen, toilet seat 20 and the sink 18 are connected to sever ducts 26 and 28. Fresh water for the sink 18, toilet 20 and shower 29 can be brought inside the vertical duct element, but sometimes the extended fresh water pipes are preferably arranged inside a suspended ceiling and mounted on surface of the inner walls of the bathroom. This drawing shows also an air removal or ventilation channels 30 that are connected to ventilation ducts 31 of the vertical duct element. It is evident that purpose and number of ducts, cabling and such placed within the vertical duct element may vary greatly depending on the needs and the standard of equipment of the building.

Figure 9:
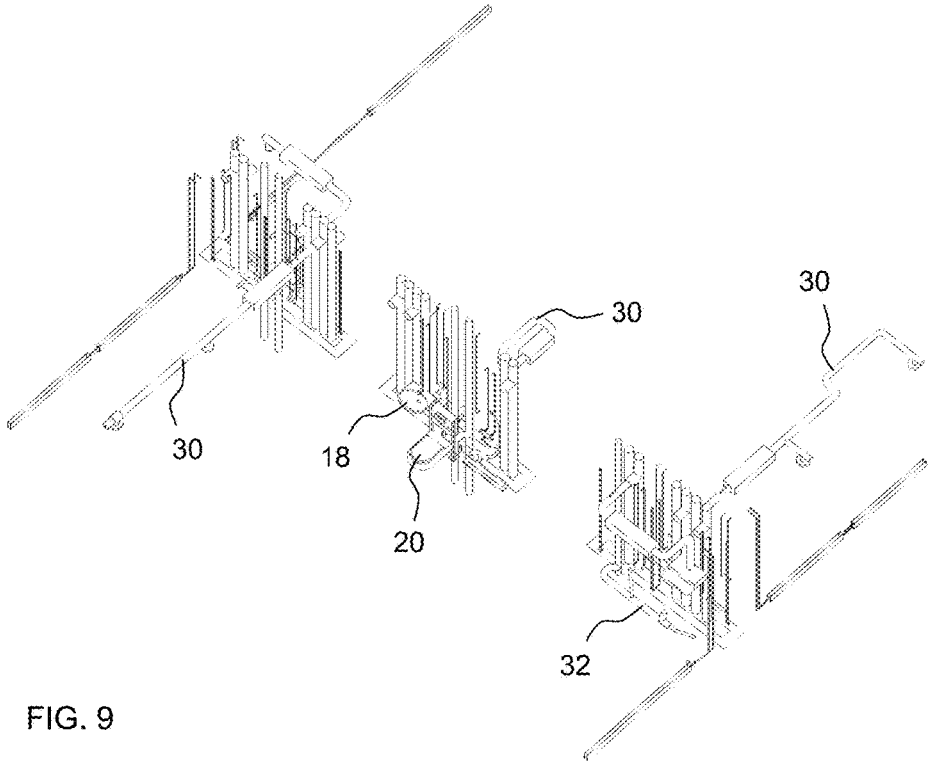
FIG. 9 is an illustrative view of one embodiment to arrange ducting needed air removal, kitchen space and bathroom on one floor level.
Figure 10:
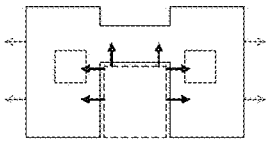
FIGS. 10-14 depict variations in how to use stair well and frame lamellas.
Figure 11:
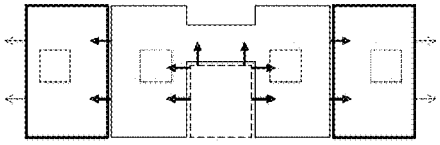
Figure 12:
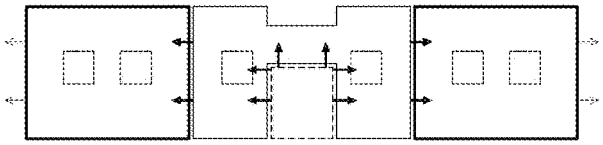
Figure 13:
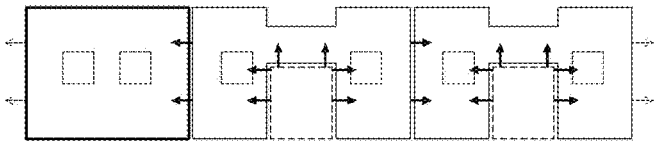

FIG. 9 shows an example of how the various technical accessories can be arranged on one floor of a building, for example in an apartment. Here a bathroom is placed in the middle and it has the same features as the bathroom described above. On one side of the bathroom is rooms that require only ventilation. Thereby only air removal channels 30 are needed in these rooms as shown in the left of the drawing. On the right side a connection to a sewer is needed, whereby a sewer pipe 32 is connected to the vertical duct element.

The connections to the ducts and cabling placed inside the vertical duct element may be accomplished by any known fittings available. However, it would be preferable that the fittings can be neatly covered when not in use.

The design of the vertical duct element may be varied, for example it may be provided by one or more divisional wall to form a cross section like U-shaped frame, letter E or a comb. These dividing walls may be load bearing or non-load bearing according to constractual needs. The element may be constructed of a load bearing frame or lattice covered by non-load bearing walls or load bearing walls. Further, even any other than rectangular cross section such as semicircles, waveforms for example can be realized. Of course these may be more costly that basic cross sections.

The invention enables various embodiments. The features of these embodiments can be divided in three categories, a) space configuration, b) structure and c) technical systems. Each of these categories will be described in more details below.

a) Space configuration

The invention is based on an idea that size of an apartment or other space in the building is not determined beforehand but the space inside the building can be used as various space entities, for example as apartments, offices or other spaces. Placing of the entrances and planning the motion inside the building is part of the concept. The space inside the building is divided in space parts and further to space units, inside which room plans and lay-outs can be made rather freely. The building itself comprises in one embodiment two different lamella types, a stair well lamella that is arranged around a stair well and a frame lamella that can be used as a independent housing unit or as a space that is not used as a dwelling. The space of the frame part can be joined to the space of the stair well lamella. Also totally new flexible space configuration can be designed or planned using the space parts and space units.

The space configuration features.

- flexible stair well lamellas, and frame lamellas with direct access to outside and entrance,
- organization of traffic inside the building so that it provides division of the space to space units with own entrances,
- space parts that are bound by load bearing vertical duct elements in both lamella types,
- reservations for openings for stairs on floors (intermediate floor),
- characterization of space parts and space units so that they enable various apartment types and division to functional room spaces,
- flexible placing of windows that enables flexible division of a space to rooms. This is possible since at least two of the outer walls may be non-load bearing walls, which enables positioning of the windows freely over the wall area.

By virtue of vertical load bearing duct element the wet spaces such as bathrooms and kitchens can be placed freely within an apartment. The floor slab may be kept free from any sewage ducts or other ducts. Since placing of the ducts within the floor slab has made it extremely difficult to change places of floor wells and other lead through or ducts, the invention greatly improves the possibilities to vary the floor plan of a given space. There is no need to open the floors. The floor, or floor slab, may also be dimensioned only according to needed load bearing capacity, which simplifies planning.

b) Structure

Flexibility of the space division of the building is accomplished by one or more of the following features:

- load bearing, partially openable vertical duct elements,
- intermediate floor that may be cast on-site and provided with reservations for stair openings,
- a removable mounting plate zone on the intermediate floor, at least on possible shower area,
- a suspended ceiling inside which ducts and cabling can be placed.

The structure enables easy changes in room lay-outs as well as long term maintenance and repairs.

One important feature is the load bearing structure of the building. It comprises above described load bearing vertical duct elements and floors that divide the building in stores. This requires joining the floors and vertical duct elements to a rigid structure. Each of the duct elements extends vertically over a height of one store and superposed duct elements have to be joined together. The positioning of the elements can be done by a template, for example. The upper end of a vertical duct element is cast closed at the level of the intermediate floor and joined to the floor slab by casting and reinforcements. In here a casting cassette made of steel plate and having necessary openings for vertical ducts can be employed. If plumbing of the building has to be completely renovated, the openable wall of the vertical duct elements is broken down, parts that have to be replaced are replaced and the openable wall closed. The openable wall may be a brick wall, for example, in which case the vertical duct element may include a ledger or beam at its lower end for supporting the brick wall.

Instead of using a cast floor structure, it can be contemplated that the floor is made of wood, for example. Then the joining of the vertical duct elements to the floor must be designed accordingly.

Figure 14:
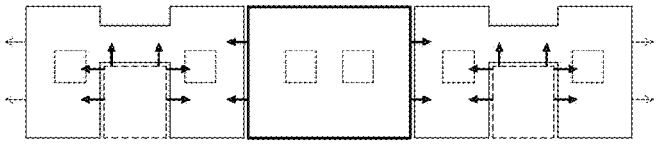

FIGS. 10 to 14 show variations of use of frame and stair well lamellas. A stair well lamella can be used alone as in FIG. 10 and it can form a building as such. The embodiment in FIG. 11 comprises a stair well lamella and a half of a frame lamella on each side of it as in FIG. 12 two full size frame lamellas are positioned on both sides of a stair well lamella. Further, in FIG. 13 two parallel stair well lamellas are used together with one frame lamella. In FIG. 14 the frame lamella is placed between two stair well lamellas. As can be seen from these examples, the invention provides great flexibility even by varying only how the lamellas are combined.

Figure 15:
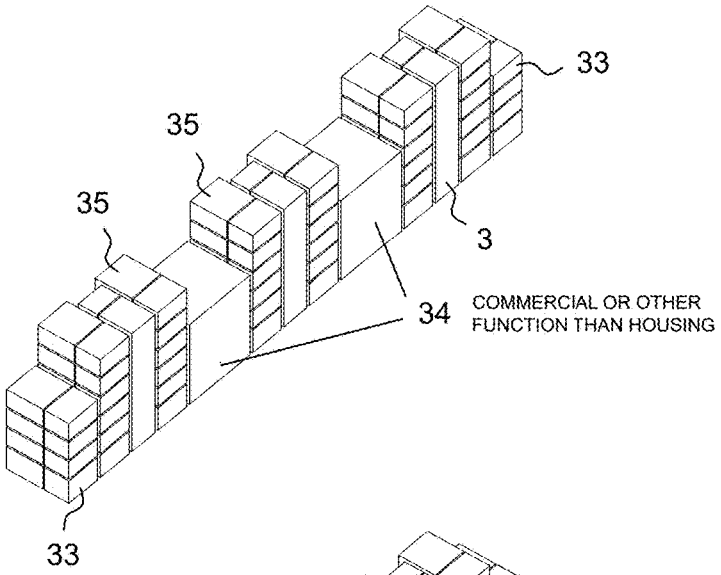
FIGS. 15 to 20 are block diagrams illustrating few possibilities to arrange and modify the space inside of the building according to the invention.
Figure 16:
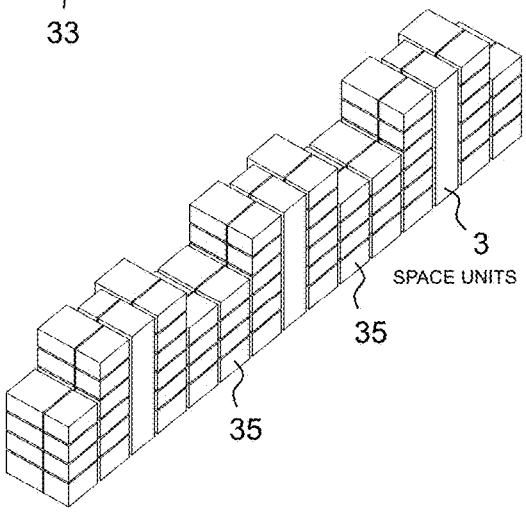

FIGS. 15 and 16 depict a building having dwellings and space for commercial or other function than housing. The commercial/other space 34 may be formed of frame lamellas, for example. The building in FIG. 15 comprises two frame lamellas, three stair well lamellas and small frame lamellas 33 at the ends of the building. The building is divided in space units 35 used both for forming dwellings of different sizes as well as commercial/other spaces. Division to commercial and dwelling space is relevant since various rules and regulations set different requirements for these spaces, for example in regard of air removal. It must be noted that the size of a space unit does not limit the size of individual rooms or other space and by combining the units even a large open floor shop or office can be formed. Only the vertical load bearing elements such as vertical duct wells can't be removed, all other wall structures are easily modifiable during design and lifetime of the building.

Figure 17:
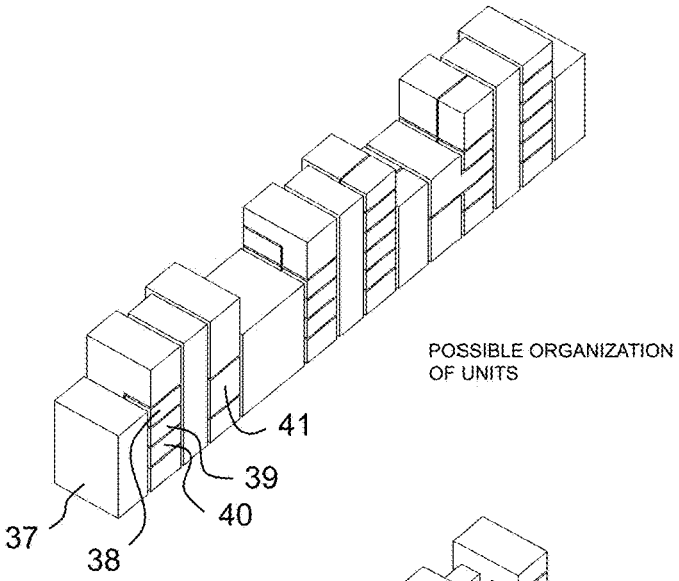
Figure 18:
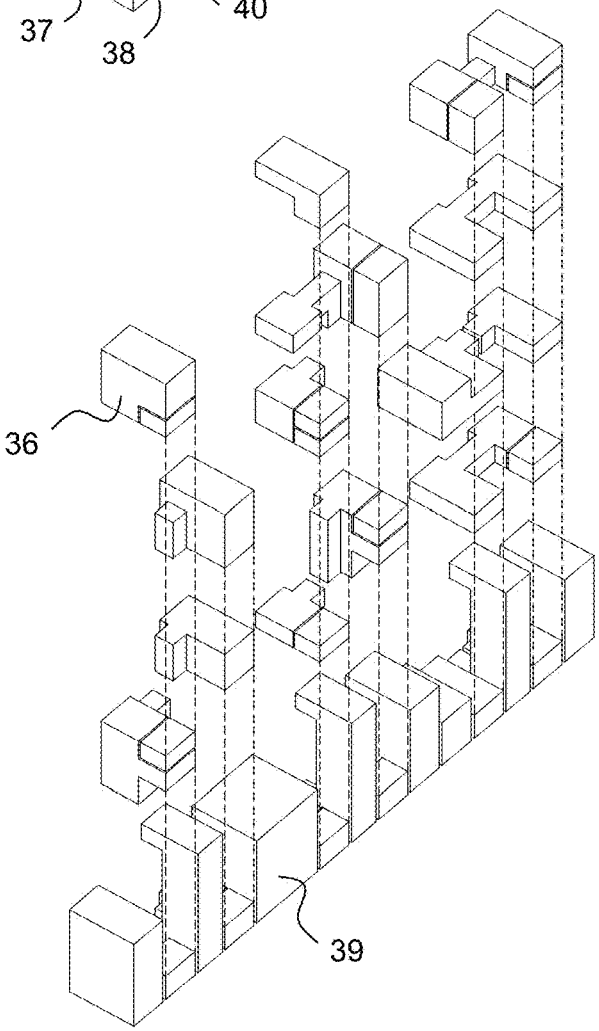
Figure 19:
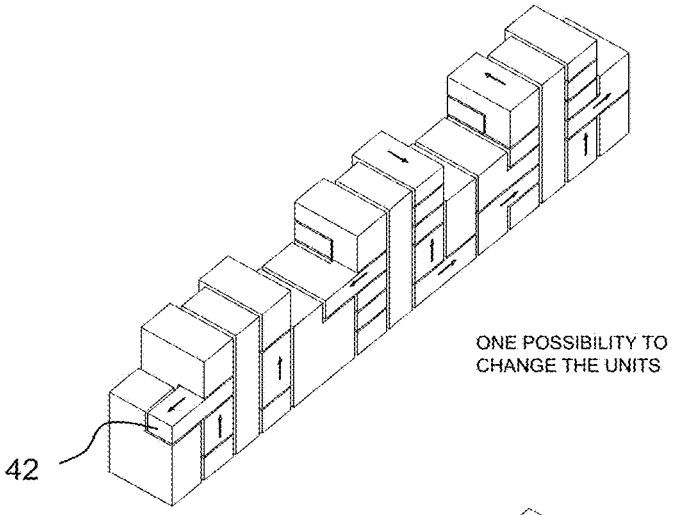
Figure 20:
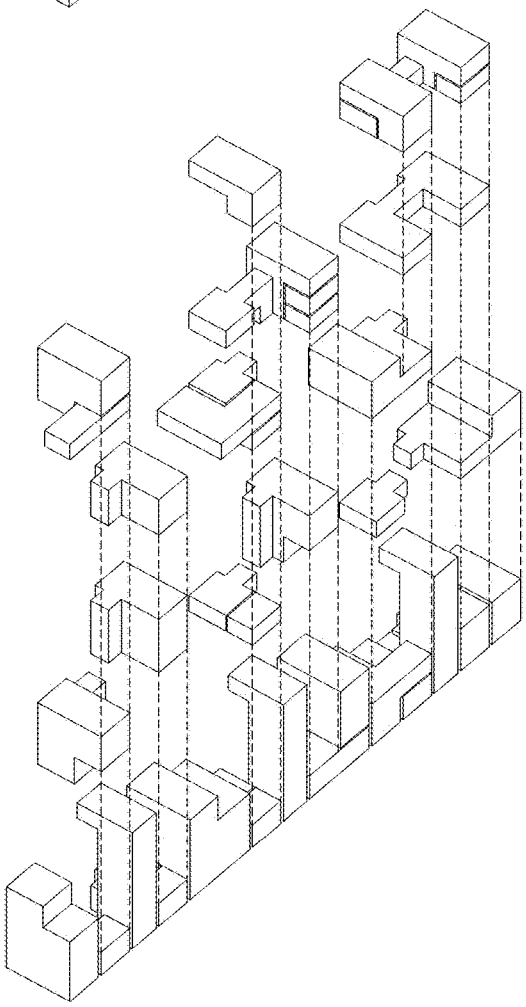

FIGS. 17 and 18 show one possibility to arrange space units into dwellings or other rooms. In FIG. 18 the blocks depicting for example an apartment 36 or a commercial space 34 are shown detached. As can be seen, by using space units various sizes of apartments or other spaces can be formed. FIG. 19 is very illustrative regarding the modifiability of the inventive building during its lifetime. Changes in space arrangement are shown by arrows in FIG. 19. For example, housing units 37 and 38 in FIG. 17 are modified so that a corner of housing unit 37 is combined with adjacent unit 38 forming a larger entity 42. By this way an owner of a larger apartment can sell and rent spaces he or she does not need to a neighbor who may need more space and rooms. This makes it possible to adjust apartments sizes to varying situations during lifetime of a person or family. Previously this has been possible only by moving to another apartment. Another way to change dwelling sizes is to combine two superimposed units together. In here units 39 and 40 of FIG. 17 are combined to a larger unit in FIG. 19. The arrows in FIG. 19 show various options how the combination or division of existing space can be accomplished according to the invention. Examples of the changes can be seen by comparing FIGS. 17 and 18 to FIGS. 19 and 20. Different permutations can be formed endlessly.

Figure 21:
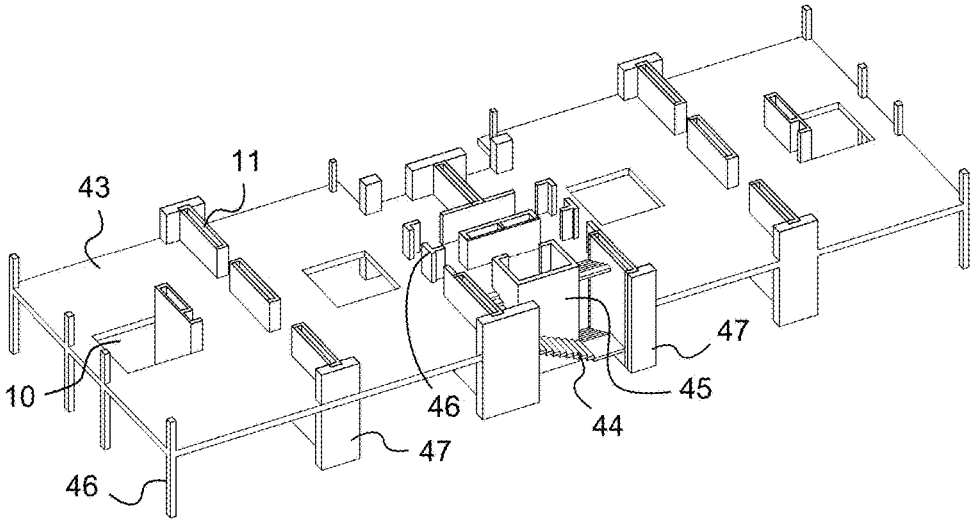
FIG. 21 show one example of how a load bearing structure of a building can be formed according to the invention.
Figure 22:
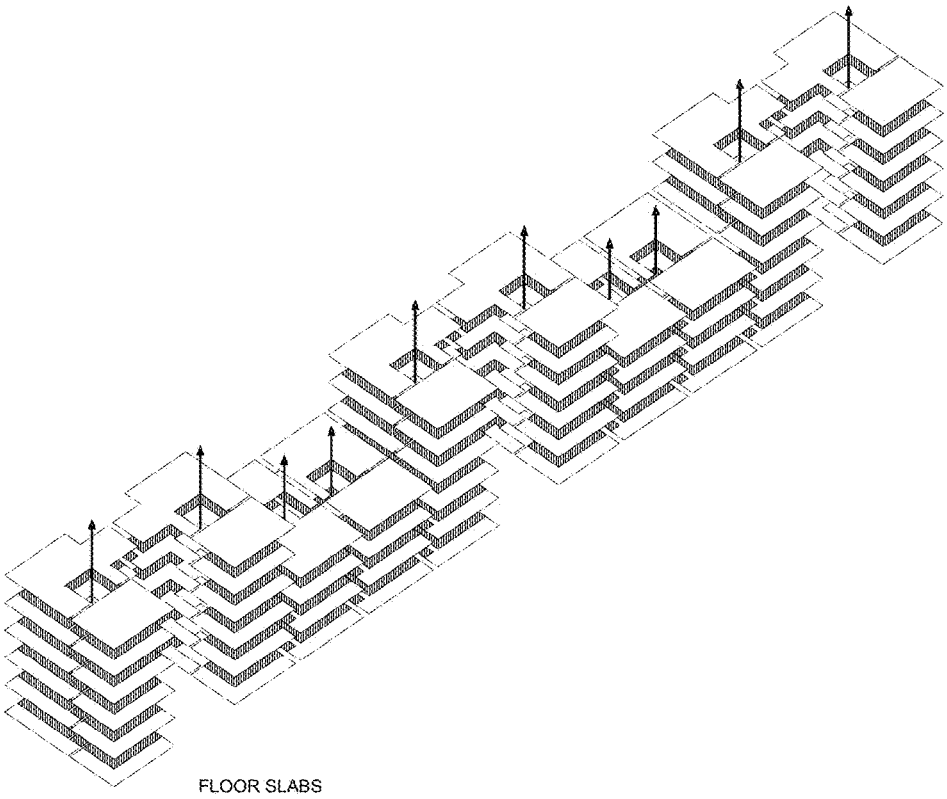
FIG. 22 illustrates one example of how access between floors can be arranged.

One example of the load bearing frame structure formed according to the invention is shown in FIG. 21. The main part of the frame comprises vertical duct elements 11 and a floor slab 43 or slabs connecting the vertical duct elements laterally. The floor may be cast on site to an integral structure with the vertical duct elements or a wooden, concrete or other structure that can be rigidly enough connected to the vertical duct elements can be used. The load bearing frame may include load bearing support pillars 46 or support slabs 47. The support slabs 47 are placed at outer edges of the vertical duct elements 11 at the outer walls. Support pillars 46 are also used mainly at outer walls of the building but may be used in any place where load bearing capacity is required and a vertical duct element is not needed. For example, the perimeter of a stair well is constructed by using vertical duct elements 11 together with support slabs 47 and support pillars 46. Now the stairs 44 can be made compact and light as they don't need to support the weight and the structural load of the building. The area of the floor can be divided into space units by non-load bearing walls. This enables easy conversion and modifiability of the floor plan. Each space unit should have one vertical duct element limiting its perimeter walls so that a kitchen and a bathroom/toilet can be arranged inside the space unit.

Figures 23, 24, 25:
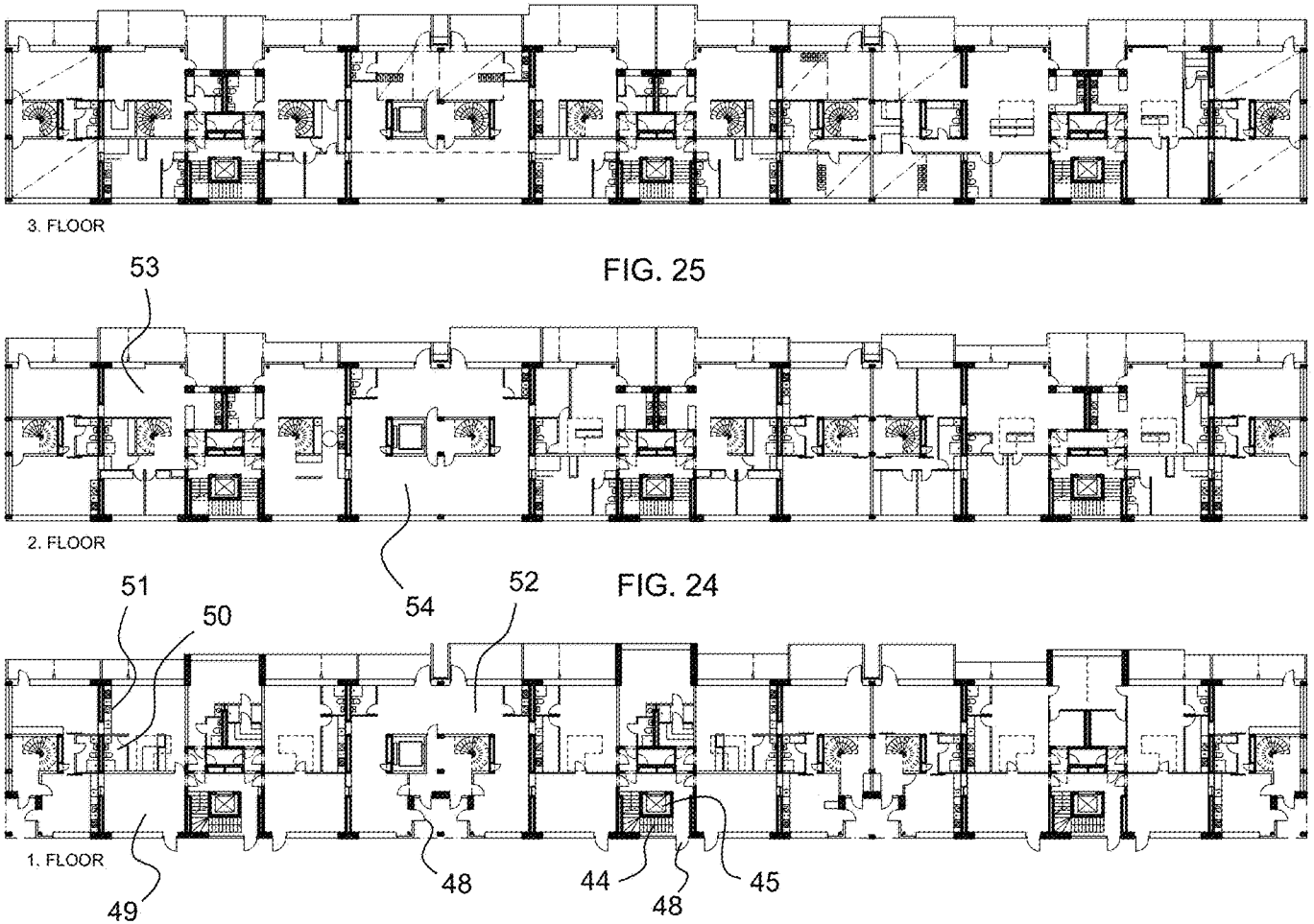
FIGS. 23 to 25 show an example of three floor plans.

FIG. 23 shows one example of a lay-out of a ground floor according to the invention.

This floor includes doors 48 for access into the building. The doors 48 may lead directly into a room or an apartment or to a stairs 44 and elevator 45. Examples of spaces on this floor include an apartment 49 with toilet 50 and a kitchen 51 and large open space 52. FIG. 24 shows an alternative for second floor. In this floor are shown different variations for apartments 53 and also larger spaces 54 for other uses. FIG. 25 shows further variations of how the space on one floor level can be used. Access between floor levels is provided by a stairwell comprising stairs 44 and a lift 45 or through the floor 43 through openings 10. The openings may include stairs, a lift or both. FIG. 26 illustrates access between floor levels.

Thus, while there have been shown and described and pointed out fundamental novel features of the invention as applied to a preferred embodiment thereof, it will be understood that various omissions and substitutions and changes in the form and details of the method and device may be made by those skilled in the art without departing from the spirit of the invention. For example, it is expressly intended that all combinations of those elements and/or method steps which perform substantially the same results are within the scope of the invention. Substitutions of the elements from one described embodiment to another are also fully intended and contemplated. It is also to be understood that the drawings are not necessarily drawn to scale but they are merely conceptual in nature. It is the intention, therefore, to be limited only as indicated by the scope of the claims appended hereto.

The invention claimed is:

1. A building comprising:

at least one space part that comprises a floor defining the area of the space part, at least one length of non-load bearing wall bordering the perimeter of the floor, at least one load bearing vertical duct element bordering the perimeter of the floor, the load bearing vertical duct element comprising at least one casting cassette, the casting cassette having at least one opening for a vertical duct, wherein walls of the opening extend upwards from the load bearing vertical duct element and wherein the casting cassette forms a passage between superposed duct elements through at least one floor, and at least one vertical cover wall that can be at least partially opened in order to provide access to the inside of the at least one load bearing vertical duct element and elements for connecting the vertical duct element to at least one adjacent floor element so that the vertical duct element carries at least a vertical load of the floor element.

2. The building according to claim 1, further comprising at least two space parts that each are bound at least on one side by load bearing vertical duct elements having a load bearing frame, and at least one second wall that can be at least partially opened in order to provide access to the inside of the element, the frame and the wall limiting a space within.

3. The building according to claim 1, wherein the at least one space part that is bound at least on two opposite sides by the at least one load bearing vertical duct element.

4. The building according to claim 1, wherein the at least one space part is bound at least on one side by the non-load bearing wall.

5. The building according to claim 1, wherein the at least one load bearing vertical duct element further comprises sections of wall which can be opened and are non-load bearing structures.

6. The building according to claim 1, wherein the at least one load bearing vertical duct element has a quadrangular cross section and includes three load bearing walls and one openable wall.

7. The building according to claim 1, wherein the space part is bound by the adjacent floor element that is manufactured on site.

8. The building according to claim 1, wherein the floor comprises at least one void reservation for passage between superimposed stores.

9. The building according to claim 1, wherein the space part comprises an openable suspended ceiling.

10. The building according to claim 1, further comprising at least one frame lamella that is bound on two opposite sides by vertical duct elements, and the frame lamella has entrance at least on ground level and void reservations for passage between superimposed stores.

11. The building according to claim 1, further comprising at least one stair well lamella that is bound on two opposite sides by vertical duct elements, and the stair well lamella comprises at least two floors and at least one stair well element for passage between superimposed floors.

12. The building according to claim 1, wherein a load bearing frame of the building is made of vertical duct elements joined by floors to a load bearing lattice framework.

13. A load bearing vertical duct element for constructing a building comprising:

a load bearing frame, a casting cassette having at least one opening for a vertical duct, wherein walls of the opening extend upwards from the load bearing vertical duct element and wherein the cast cassette forms a passage between superposed duct elements through at least one floor, at least one wall that can be at least partially opened in order to provide access to the inside of the load bearing vertical element, the frame and the wall limiting a space within, at least one duct placed in the space limited by the frame and the wall, and elements for connecting the vertical duct element to at least one floor level element so that the vertical duct element carries at least a vertical load of the floor element.

14. The load bearing vertical duct element according to the claim 13, wherein the load bearing frame has a longitudinal dimension that is defined by longest dimension of the frame and the at least one duct is running in the longitudinal direction of the load bearing frame.

15. The load bearing vertical duct element according to the claim 13, wherein the at least one opening of the at least one wall of the vertical duct element comprise non-load bearing structures.

16. The load bearing vertical duct element according to claim 13, wherein the vertical duct element has a quadrangular cross section and includes three load bearing walls and one openable wall.

17. The load bearing vertical duct element according to claim 13, wherein the vertical duct element has a quadrangular cross section having a load bearing perimeter wall and a load bearing division wall.

18. The load bearing vertical duct element according to claim 13, wherein the elements for connecting the vertical duct element and the least one floor level element comprise a surface of the vertical duct element, respectively.

19. The load bearing vertical duct element according to claim 13, wherein the vertical duct element comprises at least one connecting structure that can lead at least vertical loads from the at least one floor level element to the vertical duct element.

20. The load bearing vertical duct element according to claim 13, further comprising elements for forming passage from one superposed vertical duct element to another.

21. A method for providing a flexible building comprising:

providing at least one space part that comprises a floor defining the area of the space part and at least one length of non-load bearing wall bordering the perimeter of the floor and at least one load bearing vertical duct element bordering the perimeter of the floor and having at least one vertical cover wall that can be at least partially opened in order to provide access to the inside of the vertical duct element, and dividing the space part into at least two space units, each space unit having at least part of the at least one length of non-load bearing wall limited by the at least one vertical duct element in order to provide access inside the vertical duct element and connecting the vertical duct element to at least one floor level element so that the vertical duct element carries at least a vertical load of the floor element, wherein the vertical duct element comprises at least one casting cassette, the casting cassette comprising at least one opening for a vertical duct, wherein walls of the opening extend upwards from the load bearing vertical duct element and wherein the casting cassette forms a passage between superposed duct elements through at least one floor.

22. The method for providing a flexible building according to the claim 21, wherein the space part is divided into at least two space units by non-load bearing walls.

23. The method for providing a flexible building according to claim 21, wherein the floor plan for at least one floor may be changed at least once during the lifetime of the building.

24. The method for providing a flexible building according to claim 21, wherein a load bearing lattice of the vertical duct element and floor levels is formed, and wherein at least part of the loads in the vertical direction are carried by the vertical duct elements.

25. The method for providing a flexible building according to claim 20, further comprising elements for forming passage from one superimposed vertical duct element to another through a floor level.

* * * * *